US005119635A

United States Patent [19]

Harel

[11] Patent Number: 5,119,635

[45] Date of Patent: Jun. 9, 1992

[54] METHOD OF A MEANS FOR PURGING NON-CONDENSABLE GASES FROM CONDENSERS

[75] Inventor: Shalom Harel, Yavne, Israel

[73] Assignee: Ormat Turbines (1965) Ltd., Yavne, Israel

[21] Appl. No.: 610,305

[22] Filed: Nov. 9, 1990

Related U.S. Application Data

[63] Continuation of Ser. No. 372,757, Jun. 29, 1989, abandoned.

[51] Int. Cl.[5] ..... F01K 9/00; F28B 3/00

[52] U.S. Cl. ..... 60/692; 60/641.2; 60/671; 165/111; 165/112; 165/104.32; 165/917

[58] Field of Search ..... 60/690, 692, 693, 641.2, 60/651, 671; 165/114, DIG. 917, 112, 113, 104.32, 111; 55/269

[56] References Cited

U.S. PATENT DOCUMENTS

| | | | |
|---|---|---|---|
| 1,710,733 | 4/1929 | Hodgkinson | 165/113 |
| 1,721,287 | 7/1929 | Taddiken | 165/112 |
| 1,782,986 | 11/1930 | Dean | 165/113 |
| 2,598,799 | 6/1952 | Kiene . | |
| 3,230,729 | 1/1966 | Eber | 62/475 X |
| 3,357,197 | 12/1967 | Massengale | 62/475 X |
| 3,620,038 | 11/1971 | Muench | 62/475 X |
| 4,249,387 | 2/1981 | Crowley | 62/48.2 |
| 4,304,102 | 12/1981 | Gray | 62/475 X |
| 4,410,432 | 10/1983 | Domahidy | 60/641.2 |
| 4,766,730 | 8/1988 | Amano et al. | 60/693 X |

FOREIGN PATENT DOCUMENTS

| | | |
|---|---|---|
| 0038958 | 11/1981 | European Pat. Off. . |
| 1926395 | 11/1970 | Fed. Rep. of Germany . |
| 2095320 | 2/1972 | France . |

OTHER PUBLICATIONS

European Search Report, and Annex for EPO Application EP 90/307,065 (Sep. 26, 1990).

Bulletin No. 702-B entitled Armstrong Guide to Refrigerated Purging; Armstrong Machine Works.

*Primary Examiner*—Allen M. Ostrager

*Attorney, Agent, or Firm*—Sandler, Greenblum & Bernstein

[57] ABSTRACT

Condenser fluid comprising vaporized working fluid and non-condensable gases is treated by extracting fluid from the condenser and pressuring the fluid to liquefy the vaporized working fluid therein in such a way that the noncondensable gases are separated from the working fluid and can be vented from the extracted fluid.

35 Claims, 2 Drawing Sheets

METHOD OF A MEANS FOR PURGING NON-CONDENSABLE GASES FROM CONDENSERS

This application is a continuation of application Ser. No. 07/372,757, filed Jun. 29, 1989, now abandoned.

TECHNICAL FIELD

This invention relates to a method of and means for purging non-condensable gases from a condenser or the like.

BACKGROUND ART

Non-condensable gases almost always cause problems in Rankine cycle power plants, in air conditioning systems, and in other arrangements that utilize condensers. A major problem caused by the presence of non-condensable gases is a reduction in the heat transfer efficiency of various components in a system. That is to say, the presence of non-condensable gases in the working fluid of the system reduces the rate at which heat can be transferred from a heat source to the working fluid in a vaporizer of a Rankine cycle power plant, as well as the rate at which heat can be transferred from vapor to a cooling fluid in a condenser of a Rankine cycle power plant. The deleterious effect noncondensable gases have on the operation of a power plant is illustrated by the example described below of an actual operational system.

Waste heat is applied to a vaporizer of a Rankine cycle power plant utilizing isopentane as the working fluid. The vaporizer vaporizes the working fluid and supplies it to an organic vapor turbine designed to produce 1.5 MW by driving an electric generator. In the turbine, the vapor expands producing work and heat depleted working fluid which is supplied to a condenser. In the condenser, the heat depleted working fluid is condensed into a liquid which is pumped back into the vaporizer to repeat the cycle.

Except during very cold periods of time, the internal pressure at various locations in the power plant described above, including the condenser, will exceed atmospheric pressure. Nevertheless, even under these conditions, experience proves that ambient air leaks into the working fluid through the metal piping, flanges, joints, etc. Apparently, air diffuses through the metal piping and seals even when the pressure inside the system exceeds ambient pressure.

The effect on the power output of a power plant having non-condensable gases in the working fluid is significant. For example, in relatively small systems designed to produce about 1.5 MW, experience has shown more than a 10% decrease in power may result if a constant program of purging noncondensable gases from the system is not carried out, an amount that is significant in terms of the total power output.

The conventional approach to purging non-condensable gases from the condenser of a power plant of the type described is to utilize a vacuum pump arrangement by which fluid (vaporized working fluid and non-condensable gases) in the condenser is admitted to a cooled chamber. The result is a miniature condenser wherein the working fluid condenses and is thus separated from the non-condensable gases which are vented from the chamber before the condensed working fluid is returned to the system.

While this approach is satisfactory in some instances, it is unsatisfactory in many instances because of the power consumption involved, and because of the complex equipment needed to establish and maintain a vacuum. Furthermore, the conventional approach is insensitive to the amount of noncondensable gases in the power plant system requiring continuous operation that, itself, is a disadvantage in many cases. Furthermore, experience proves that extraction of non-condensable gases requires operation of the purging system over long periods of time because the non-condensable gases often are dissolved in the working fluid, and only slowly are released and extracted in the purging system associated with the condenser. Thus, constant operation is often required to ensure removal of these gases. Also, during cooling of the fluid in the cooled chamber, even though a substantial portion of the working fluid is condensed and returned to the system, a large portion of working fluid remains in vapor form and is extracted together with the non-condensable gases during the operation of the vacuum pump. This portion is lost to the system.

It is therefore an object of the present invention to provide a new and improved method of an means for purging non-condensable gases from a condenser which is more efficient than other systems previously known, simpler to maintain control and operate, more sensitive to the actual amount of non-condensable gases in the system, and effective in substantially minimizing the amount of working fluid lost from the system.

BRIEF DESCRIPTION OF THE INVENTION

Apparatus in accordance with the present invention for purging non-condensable gases from a condenser or the like containing vaporized working fluid includes a chamber, and a valve having an open state for connecting the condenser to the chamber, and having a closed state for disconnecting the condenser from the chamber. Associated with the chamber is an element, made effective when the valve is in its closed state, to condense working fluid in the chamber thereby separating the same from non-condensable gases in a chamber. A selectively operable vent connected to the chamber permits the latter to be vented when the valve is in its closed state. A relief valve connected to the vent substantially prevents extraction of working fluid from the system when no non-condensable gases are present in the chamber.

The apparatus according to the invention thus provides for the extraction of fluid from the condenser, the fluid containing both vaporized working fluid and non-condensable gases. The fluid so extracted from the condenser is pressurized in such a way that the working fluid is liquefied and separated from the non-condensable gases. Loss of working fluid from the system being purged is substantially prevented or minimized.

BRIEF DESCRIPTION OF THE DRAWINGS

Embodiments of the present invention are shown in the accompanying drawings wherein.

DETAILED DESCRIPTION

Figure 1:
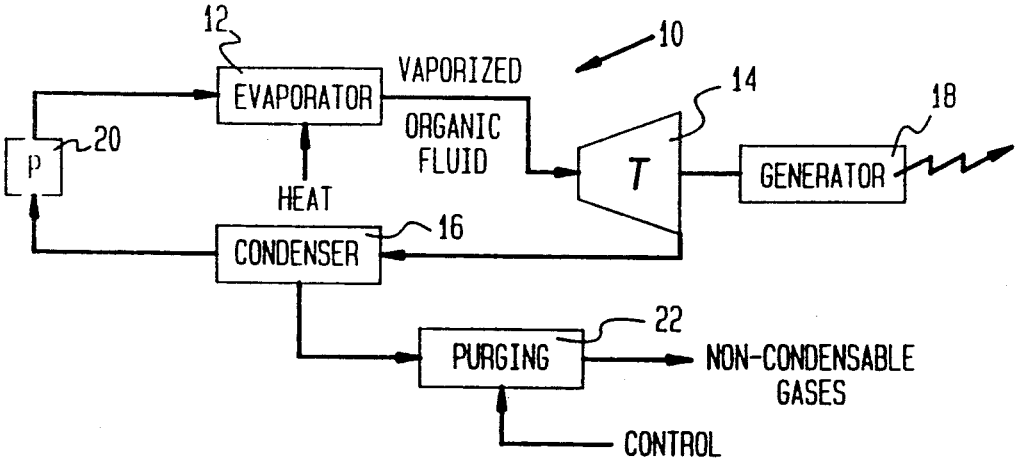
FIG. 1 is a block diagram of a Rankine cycle power plant utilizing an organic working fluid showing, in general form, the application of the present invention to the power plant.

Turning now to the drawings, reference numeral 10 designates a Rankine cycle power plant according to the present invention wherein the purging of non-condensable gases from the condenser of the power plant is achieved by using purging system 22. Power plant 10 comprises vaporizer 12 to which heat is applied for evaporating a working fluid such as an organic liquid (e.g., isopentane, or other hydrocarbon, or halogenated hydrocarbon). The heat may be waste heat from an industrial process, heat contained in natural sources such as geothermal fluid, or may be from the burning of natural or manufactured fuel.

Vaporized working fluid produced by vaporizer 12 is applied to organic vapor turbine 14 in which the vaporized working fluid expands and produces work and heat depleted working fluid which is supplied to condenser 16. Work produced by the turbine drives electrical generator 18 which supplies power to an electrical grid (not shown). A typical system would require turbo-generator 14/18 to produce maximum rated power over long periods of time with a minimum of maintenance. Heat depleted working fluid in condenser 16 is cooled, by air or cooling water; and the working fluid condenses into a liquid that is returned to vaporizer 12 by pump 20 where the cycle repeats.

From experience, it has been found that one of the causes of a power reduction under conditions of fixed heat input and ambient temperatures, is a build-up of noncondensable gases in the condenser and elsewhere in the system. Such build-up reduces the heat transfer coefficients in the various heat exchangers in the power plant to a point where the power produced drops below its expected value.

In order to maintain the power produced by power plant 10 at substantially its expected value, purging system 22, according to the present invention, operates in the manner described below by extracting fluid from the condenser. Such fluid is a mixture of heat depleted vaporized working fluid and non-condensable gases; and the fluid is externally compressed in such a way that the working fluid is liquefied and separated from the non-condensable gases.

The liquefied working fluid is returned to the condenser, and the non-condensable gases are vented. This operation is carried out periodically, preferably in accordance with a series of control signals, e.g., every 20 minutes, to substantially purge the non-condensable gases and thus substantially maintain the power level of the power plant. Alternatively, such operation can be carried out until a monitor (not shown) monitoring the power level of generator 18 determines that the power output thereof returns to its set level, i.e., until the amount of non-condensable gases in the system is reduced to a level at which minimal effect is exerted by the gases on the efficiency of the power plant.

Figure 2:
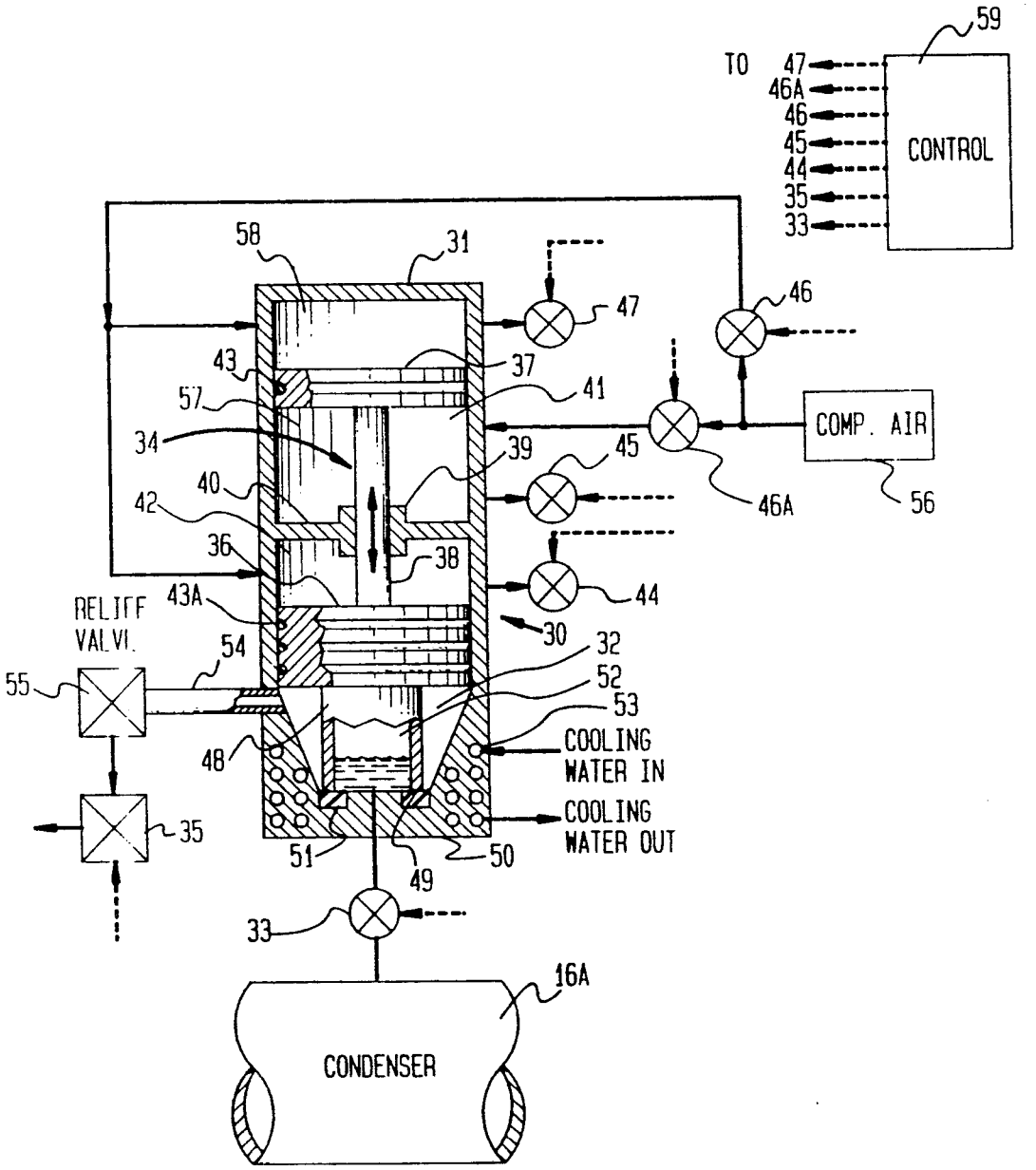
FIG. 2 is a schematic diagram, partly in section, and showing parts partly broken away, illustrating one embodiment of the present invention.

An embodiment of a purging system according to the present invention is shown in FIG. 2 and designated by reference numeral 30. System 30 comprises housing 31 defining variable volume chamber 32, valve 33 having an open state for connecting condenser 16A to chamber 32, and having a closed state for disconnecting the condenser from the chamber, and control unit 59 for controlling the operation of the purging system. The state of the valve is determined in accordance with the nature of the control signal applied thereto.

System 30 further comprises means associated with the chamber, namely piston assembly 34, made effective in the manner described below when valve 33 is in its closed state to condense working fluid in the chamber in a way that separates the working fluid from the noncondensable gases in the chamber. Once separation is effected, valve 35 is tripped by a control signal, and the non-condensable gases are vented. During the interval that the gases are vented, valve 33 remains closed.

Assembly 34 is in the form of a double-ended piston, and comprises lower piston 36 connected to upper piston 37 by piston rod 38 passing through sealing sleeve 39 in transverse wall 40 which divides the interior of housing 31 into upper cylinder 41 and lower cylinder 42. Piston 37, carrying O-ring seal 43 on its periphery, slideably moves in upper cylinder 41, and piston 36, carrying O-ring seals 43A on its periphery, slideably moves in a lower cylinder 42 which includes variable chamber 32 whose volume is established by the movement of piston 36 in response to controlled operation of air valves 45, 46 or valves 44, 46A, and 47 as described below.

The lower, free end of piston 36 is provided with a cup-like extension in the form of sleeve 48 whose free edge 49 faces closed bottom end 50 of housing 31. Edge 49 engages annular seal 51 embedded in end 50 when piston 36 approaches the limit of its travel thereby sealing region 52 defined by sleeve 48 from the balance of chamber 32 for the reason explained below.

The interior wall defining chamber 32 is tapered meeting end 50 in the vicinity of seal 51. This portion of the wall is also provided with means for cooling the contents of chamber 32; and the preferred way to achieve this end is embedded cooling coil 53 to which cooling water is supplied. Finally, exit tube 54 connects chamber 32 to the exterior of the housing through relief valve 44 and controlled valve 35.

In operation, control unit 59 produces a programmed series of control signals that are applied to valves 33, 35 and 44–47 in their quiescent state wherein valve 33 is closed, as are valves 46, 46A; and assembly 34 is in the position shown in FIG. 2. Such control signals are effective to first raise the piston assembly in the housing for drawing fluid in the condenser into chamber 32, and subsequently permit further fluid in the condenser to flow into this chamber, to trap the fluid in the chamber, and then to lower the piston to compress the trapped fluid such that vaporized working fluid present in chamber 32 is condensed and separated from non-condensable gases that are then vented from the chamber.

To this end, the control signals cause valve 33 to open and valve 35 to close thereby connecting the interior of condenser 16A to chamber 32, which at this time has a minimum volume. Valve 46 is then opened allowing compressed air from supply 56 to enter chamber 57, defined by the space between piston 37 and wall 40. At the same time, valves 44 and 47 are opened. As a result, the compressed air imparts upward displacement to pistons 36 and 37; and the resultant enlargement of chamber 32 reduces the pressure in the chamber and draws in fluid from the condenser through open valve 33. Such fluid is a mixture of heat depleted working fluid in the condenser and non-condensable gases in the condenser.

When the piston assembly at its upper dead-center position, the volume of chamber 32 is a maximum, and fluid from the condenser continues to flow into this chamber. Due to the presence of cooling water in cooling coil 53, vaporized working fluid present in the chamber condenses. The resultant condensate drips back into condenser 16A while non-condensable gases from condenser 16A continue to collect in chamber 32 because the non-condensable gases are lighter than the vaporized working fluid. Subsequently, valves 33 and 46A are closed as are valves 44 and 47 thus trapping the fluid present in chamber 32. The control signals from control unit 59 are then effective to impart downward movement to the piston assembly valve 46 is opened allowing compressed air from supply 56 to enter chambers 42 and 58. Simultaneously, valve 45 is opened. Thus, fluid trapped in chamber 32 is compressed as the volume of the chamber decreases toward its minimum value. As a consequence, and also due to cooling by the cooling water flowing in coils 53, working fluid present in chamber 32 condenses into a liquid.

Seal 51, in cooperation with free edge 49 on sleeve 48, serves to trap the condensed working fluid as shown in FIG. 2 in the cup-like extension on piston 36, the non-condensable gases being separated from the condensed working fluid and being trapped in the annular region surrounding sleeve 48. At this point, the control signals are effective to open valve 35 to vent the annular region surrounding sleeve 48, thereby venting non-condensable gases and vaporized working fluid remaining in chamber 32, and to open valve 33 to effect return of liquefied working fluid to the condenser. Thereafter, valves 35 and 33 are closed; and the cycle is repeated periodically. In the case where no non-condensable gases accumulate or are present in chamber 32, no pressure will build up as piston 36 travels downwardly. Relief valve 55, which is adjusted to operate at a pressure slightly above that of the condenser will not open; and consequently, extraction of working fluid from then system is prevented.

Figure 3:
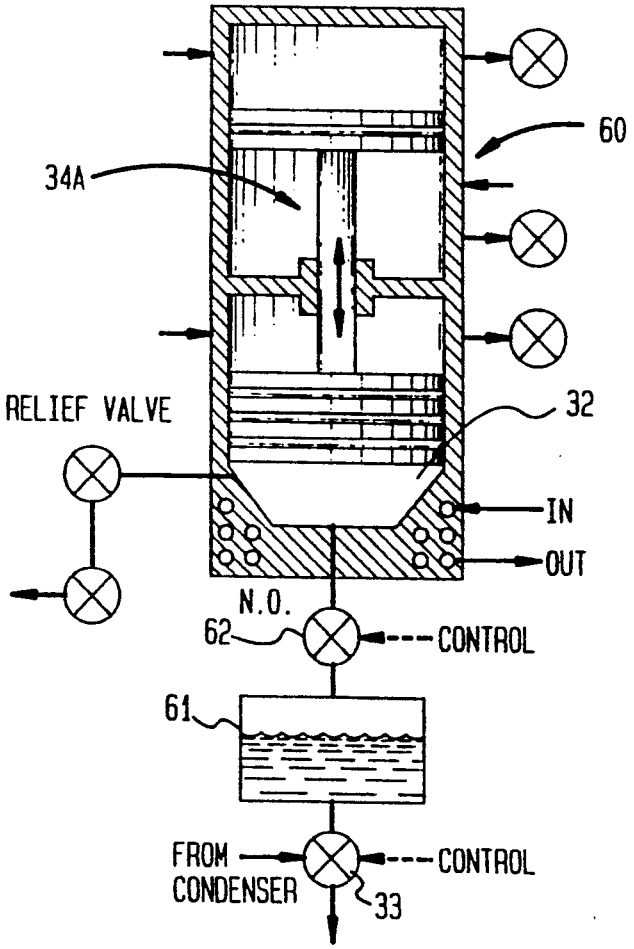
FIG. 3 is a second embodiment of the present invention.

The preferred embodiment of the invention is designated by reference numeral 60 in FIG. 3. System 60 differs from system 30 essentially in the elimination of sleeve 48 and its seal 51 in favor of tank 61 interposed between valve 33 and the system. In system 60, normally open valve 62 is located between tank 61 and system 60.

The operation of system 60 is essentially the same as the operation of system 30, except that in the case of system 60, tank 61 serves to separate condensed working fluid from non-condensable gases in chamber 32. That is to say, upon downward movement of assembly 34A in system 60, the cooled and liquefied working fluid that results drains into tank 61 because valve 33 is open during the compression stroke of the assembly. At the end of the compression stroke, valve 62 is closed as valve 33 is opened to effect drainage of the working fluid in tank 61 into the condenser.

The orientation of the purging apparatus according to the inventions preferably as indicated in the drawing with the apparatus being located physically above the condenser to effect a gravitational return of the condensed working fluid into the condenser, and also to permit the lighter non-condensable gases to flow up into the purging apparatus. The non-condensable gases will be lighter than the working fluid when the latter is am organic working fluid. However, the apparatus could be located below the condenser if a pump were available to return the condensed working fluid to the condenser. Furthermore, the present invention is also applicable for purging systems where the non-condensable gases are heavier than the working fluid, e.g., where water or steam is the working fluid.

Even though the embodiment shown in FIG. 2 shows the presence of five separate air operated valves (i.e., valves 44–47), these valves may be replaced by one four-way, three position (up-down-neutral), double operation (two solenoid, spring, neutral return) valve.

While the above description of the present invention is associated with a Rankine cycle power plant, the invention is applicable to any system having a condenser in which noncondensable gases are a problem. Examples of other systems to which the present invention is applicable are air conditioning systems and refrigeration systems.

In an example of the use of the present invention, a ratio of 1:7 for the ratio of the maximum volume of chamber 32 to the minimum volume has been used when the air pressure of supply 56 was about 7 atmospheres (above atmospheric pressure) to vent non-condensable gases from a condenser operating at about 1.5 atmospheres above atmospheric, pressure. It was found that the purging apparatus maintained the condenser operating pressure when the purging apparatus was operated at ten minute intervals.

The advantages and improved results furnished by the method and apparatus of the present invention are apparent from the foregoing description of the preferred embodiment of the invention. Various changes and modifications may be made without departing from the scope of the invention as described in the appended claims.

I claim:

1. Apparatus for purging non-condensable gases from condensers or the like containing vaporized working fluid, said apparatus comprising:

a) a chamber;

b) a valve having an open state for connecting the condenser to said chamber, and having a closed state for disconnecting the condenser from said chamber;

c) means associated with the chamber and made effective when the valve is in its closed state to pressurize the contents of the chamber for condensing working fluid in the chamber thereby separating the working fluid from non-condensable gases in the chamber; and d) means to vent the chamber while said valve is in its closed state.

2. Apparatus for purging non-condensable gases from condensers or the like containing vaporized working fluid, said apparatus comprising:

a) a chamber;

b) a valve having an open state for connecting the condenser to said chamber, and having a closed state for disconnecting the condenser from said chamber;

c) means associated with the chamber and made effective when the valve is in its closed state to condense working fluid in the chamber thereby separating the working fluid from non-condensable gases in the chamber;

d) means to vent the chamber while said valve is in its closed state; and e) wherein said means associated with the chamber includes operating means for effecting the flow of fluid from the condenser into said chamber when the valve is in its open state, and for compressing fluid in the chamber when the valve is in its closed state.

3. Apparatus according to claim 2 wherein said means associated with the chamber includes cooling means for cooling liquid in the chamber when the fluid is compressed.

4. Apparatus according to claim 3 wherein said operator means includes a piston in said chamber movable between two axial positions that define a maximum volume and a minimum volume, a piston operator for moving said piston between its two axial positions, and a control system for causing said piston operator to move the piston to an axial position defining a maximum volume when the valve is open, and to move the piston to the axial position defining a minimum valve when the valve is closed thereby effecting compression of the working fluid and non-condensable gases in the minimum volume and causing the working fluid to liquefy.

5. Apparatus according to claim 4 including means for separating working fluid that condenses to a liquid from the non-condensable gases.

6. Apparatus according to claim 5 wherein said means for separating includes a cup-like member on the piston, said member having a free end an opening toward a closed end of the chamber, and forming a region within which liquefy working fluid collects when the piston moves to its axial position defining a minimum volume of the chamber.

7. Apparatus according to claim 6 wherein the closed end of the chamber includes a seal that engages and cooperates with the free end of the member when the piston moves to its axial position defining a minimum volume of the chamber thereby separating the region from the remainder of the minimum volume of the chamber.

8. Apparatus according to claim 7 wherein the operator means include a second piston rigidly connected to the first mentioned piston, said piston operator including compresses air for effecting movement of the pistons in the chamber.

9. Apparatus according to claim 4 wherein said means for separating includes a tank interposed between the valve and the chamber, and a normally opened valve connecting the tank to the chamber.

10. A Rankine cycle power plant comprising:

a) a vaporizer for vaporizing an organic working fluid and producing vaporized working fluid;

b) a turbine responsive to vaporized working fluid produced by said vaporizer for producing work and heat depleted working fluid;

c) a condenser responsive to heat depleted working fluid for condensing the same into a liquid which is returned to the vaporizer; and d) apparatus for purging non-condensable gases from said condenser, said apparatus comprising:

(1) a chamber;

(2) a valve for having an open state for connecting the condenser to said chamber, and a closed state for disconnecting the chamber from said condenser;

(3) means associated with the chamber and made effective when the valve is in its closed state to pressurize the contents of the chamber for condensing working fluid in the chamber thereby separating the same from non-condensable gases therein;

(4) means to vent the chamber when said valve is in its closed state.

11. A Rankine cycle power plant comprising:

a) a vaporizer for vaporizing an organic working fluid and producing vaporized working fluid;

b) a turbine responsive to vaporized working fluid produced by said vaporizer for producing work and heat depleted working fluid;

c) a condenser responsive to heat depleted working fluid for condensing the same into a liquid which is returned to the vaporizer; and d) apparatus for purging non-condensable gases from said condenser, said apparatus comprising:

(1) a chamber;

(2) a valve for having an open state for connecting the condenser to said chamber, and a closed state for disconnecting the chamber from said condenser;

(3) means associated with the chamber and made effective when the valve is in its closed state to condense working fluid in the chamber thereby separating the same from non-condensable gases therein;

(4) means to vent the chamber when said valve is in its closed state; and e) wherein said means associated with the chamber includes operating means for effecting the flow of fluid from the condenser into said chamber when the valve is in its open state, and for compressing fluid in the chamber when the valve is in its closed state.

12. A Rankine cycle power plant according to claim 11 wherein said means associated with the chamber includes cooling means for cooling fluid in the chamber thereby liquefying the working fluid which is thus separated from the non-condensable gases.

13. A Rankine cycle power plant according to claim 12 wherein said operator means includes a piston in said chamber movable between two axial positions that define a maximum volume and a minimum volume, a piston operator for moving said piston between its two axial positions, and a controlled system for causing said piston operator to move the piston to an axial position defining a maximum volume when the valve is open, and to move the piston to an axial position defining a minimum volume when the valve is closed thereby compressing the working fluid and non-condensable gases in the minimum volume and causing the working fluid to liquefy.

14. A Rankine cycle power plant according to claim 13 including means for separating working fluid that condenses to a liquid from the non-condensable gases.

15. A Rankine cycle power plant according to claim 14 wherein said means for separating includes a cup-like member on the piston, said member having a free end an opening toward a closed end of the chamber, and forming an region within which liquefy working fluid collects when the piston moves to its axial position defining a minimum volume of the chamber.

16. A Rankine cycle power plant according to claim 15 wherein the closed end of the chamber includes a seal that engages and cooperates with the free end of the member when the piston moves to its axial position defining a minimum volume of the chamber thereby separating the region from the remainder of the minimum volume of the chamber.

17. A Rankine cycle power plant according to claim 16 wherein the operator means include a second piston rigidly connected to the first mentioned piston, said piston operator including compressed air for effecting movement of the pistons in the chamber.

18. A Rankine cycle power plant according to claim 14 wherein said means for separating includes a tank interposed between the valve and the chamber, and a normally opened valve connecting the thank to the chamber.

19. A Rankine cycle power plant according to claim 18 wherein the tank and the chamber are located physically above the condenser to effect the return of liquid working fluid to the condenser when the valve is open.

20. A method for treating fluid in a condenser which comprises vaporized working fluid and non-condensable gases said method comprising the steps of:

a. extracting fluid from the condenser; and b. pressuring said fluid to liquefy working fluid therein thereby separating the working fluid from the non-condensable gases.

21. Apparatus according to claim 5 including venting means for venting non-condensable gases, and a relief valve connected to said venting means for substantially preventing the venting of any working fluid.

22. Apparatus according to claim 4 wherein the ratio of said maximum to said minimum volume is about 1 to 7.

23. Apparatus comprising:

a) a housing containing a fluid that includes non-condensable and condensable gases;

b) means for extracting fluid from the housing; and c) means for pressurizing said extracted fluid to liquefy the condensable gases therein thereby separating the latter from the non-condensable gases.

24. Apparatus according to claim 23 including a chamber for receiving the fluid extracted from said housing, and means for removing said non-condensable gases from the chamber.

25. Apparatus according to claim 24 including means for returning the condensable gases in said chamber to said housing.

26. Apparatus according to claim 25 wherein said housing is a condenser, and said condensable gases include a vaporized working fluid.

27. Apparatus for purging non-condensable gases from a vaporized fluid, said apparatus comprising:

a) a chamber;

b) a controllable valve having an open state for effecting admission of said vaporized fluid and non-condensable gases into said chamber, and having a closed state for trapping vaporized fluid and non-condensable gases in said chamber;

c) means associated with the chamber and made effective only when the valve is in its closed state for pressurizing the contents of the chamber and condensing vaporized fluid trapped in the chamber thereby separating the fluid from non-condensable gases in the chamber; and d) means to vent the chamber while said valve is in its closed state.

28. Apparatus for purging non-condensable gas from a vaporized fluid, said apparatus comprising:

a) a chamber;

b) a controllable valve having an open state for effecting admission of said vaporized fluid and non-condensable gases into said chamber, and having a closed state for trapping vaporized fluid and non-condensable gases in said chamber;

c) means associated with the chamber and made effective only when the valve is in its closed state for condensing vaporized fluid trapped in the chamber thereby separating the fluid from non-condensable gases in the chamber; and d) means to vent the chamber while said valve is in its closed state; and e) including means for compressing fluid in the chamber when the valve is in its closed state.

29. Apparatus according to claim 28 wherein said means for compressing includes a piston in said chamber movable between two axial positions that define a maximum volume and a minimum volume, a piston operator for moving said piston between its two axial positions, and a control system for causing said piston operator to move the piston to an axial position defining a maximum volume when the valve is open, and to move the piston to the axial position defining a minimum valve when the valve is closed thereby effecting compression of the vaporized fluid and non-condensable gases in the minimum volume and causing the vaporized fluid to liquefy.

30. Apparatus for purging non-condensable gases from condensers or the like containing vaporized working fluid, said apparatus comprising:

a) a chamber;

b) operable valve means for selectively connecting and disconnecting the chamber to the condenser;

c) means associated with the chamber and made effective when the valve means disconnects the chamber from the condenser for compressing the contents of the chamber to condense working fluid in the chamber to a liquid; and d) means to vent the chamber when said valve means disconnects the chamber from the condenser.

31. Apparatus according to claim 30 for cooling the chamber as its contents are compressed.

32. A method for treating fluid in a condenser which comprises vaporized working fluid and non-condensable gases said method comprising the steps of:

a) extracting fluid from the condenser into a chamber;

b) disconnecting the chamber from the condenser; and c) compressing the fluid in the chamber for liquefying working fluid therein.

33. A method according to claim 32 including venting the chamber after the fluid therein is compressed and while the chamber is disconnected from the condenser.

34. A method according to claim 33 including returning liquid in the chamber to the condenser after the chamber is vented.

35. A method according to claim 32 including the step of cooling the fluid in the chamber as the fluid is being compressed.

* * * * *